US009419355B2

(12) United States Patent
Lee et al.

(10) Patent No.: US 9,419,355 B2
(45) Date of Patent: Aug. 16, 2016

(54) DISPLAY MODULE WITH DUAL POWER LINES

(71) Applicant: SAMSUNG ELECTRONICS CO., LTD., Suwon-Si, Gyeonggi-Do (KR)

(72) Inventors: Seung-Bae Lee, Yongin-Si (KR); Sung-Chul Kim, Yongin-Si (KR); Se-Il Kim, Seoul (KR); Kyung-Won Park, Yongin-Si (KR); Jung-Man Lim, Osan-Si (KR)

(73) Assignee: SAMSUNG ELECTRONICS CO., LTD., Suwon-Si, Gyeonggi-Do (KR)

( * ) Notice: Subject to any disclaimer, the term of this patent is extended or adjusted under 35 U.S.C. 154(b) by 204 days.

(21) Appl. No.: 14/072,399

(22) Filed: Nov. 5, 2013

(65) Prior Publication Data

US 2014/0160696 A1 Jun. 12, 2014

(30) Foreign Application Priority Data

Dec. 7, 2012 (KR) ..... 10-2012-141982

(51) Int. Cl.

| | |
|---|---|
| ***H01R 12/62*** | (2011.01) |
| ***H01R 12/70*** | (2011.01) |
| ***G09G 3/20*** | (2006.01) |
| ***G09G 3/32*** | (2016.01) |
| ***G09G 3/36*** | (2006.01) |

(52) U.S. Cl.

CPC ..... *H01R 12/62* (2013.01); *G09G 3/20* (2013.01); *G09G 3/3208* (2013.01); *G09G 3/3696* (2013.01); *G09G 2330/02* (2013.01); *G09G 2330/06* (2013.01); *G09G 2330/08* (2013.01); *H01R 12/7076* (2013.01)

(58) Field of Classification Search

CPC ..... H01R 12/62; H01R 12/7076

See application file for complete search history.

(56) References Cited

U.S. PATENT DOCUMENTS

| | | | | |
|---|---|---|---|---|
| 6,160,346 | A | 12/2000 | Vleggaar et al. | |
| 6,201,346 | B1 | 3/2001 | Kusaka | |
| 6,274,978 | B1 * | 8/2001 | Roach | G09F 9/305 313/483 |
| 6,424,400 | B1 * | 7/2002 | Kawasaki | G02F 1/13452 349/149 |
| 6,603,107 | B2 * | 8/2003 | Miyake | H01R 4/04 250/208.1 |
| 6,633,134 | B1 * | 10/2003 | Kondo | G09G 3/3225 313/504 |
| 6,734,941 | B2 * | 5/2004 | Yamazaki | G02F 1/13452 349/150 |

(Continued)

FOREIGN PATENT DOCUMENTS

| | | |
|---|---|---|
| JP | 01-187795 | 7/1989 |
| JP | 04-147219 | 5/1992 |

(Continued)

*Primary Examiner* — Jeremy C Norris
*Assistant Examiner* — Nathan Milakovich
(74) *Attorney, Agent, or Firm* — F. Chau & Associates, LLC

(57) ABSTRACT

A display module includes a display panel, a driver integrated circuit, a flexible printed circuit (FPC), a drive signal wiring and a power wiring. The driver integrated circuit applies power and a drive signal to the display panel. The FPC is electrically connected between the driver integrated circuit and a PCB. The drive signal wiring is extended from the FPC to the display panel through the driver integrated circuit and may transmit the drive signal to the display panel. The power wiring transmits the power to the display panel. The power wiring includes a first power line extended from the FPC to the driver integrated circuit, and a second power line extended from the first power line to the display panel. The second power line does not intersect the drive signal wiring, and a ground slit is not generated.

9 Claims, 3 Drawing Sheets

(56) References Cited

U.S. PATENT DOCUMENTS 6,738,123 B1 * 5/2004 Takahashi ..... G02F 1/13452 257/E21.511
6,774,973 B2 8/2004 Ko
6,801,289 B2 * 10/2004 Ichioka ..... G02F 1/1345 349/149
7,034,442 B2 * 4/2006 Hirayama ..... G02F 1/1345 174/255
7,050,138 B1 5/2006 Yamazaki et al.
7,139,060 B2 * 11/2006 Cheng ..... G02F 1/13452 257/E21.514
7,436,050 B2 * 10/2008 Yamazaki ..... H01L 21/6835 257/678
7,683,471 B2 3/2010 Chung et al.
7,705,812 B2 * 4/2010 Yuda ..... G02F 1/13452 345/206
7,952,676 B2 5/2011 Lee et al.
8,450,753 B2 * 5/2013 Shiota ..... G02F 1/13452 257/678
8,853,694 B2 * 10/2014 Han ..... H01L 23/49524 257/48
9,052,789 B2 * 6/2015 Yau et al. ..... H05K 1/0289
9,059,162 B2 * 6/2015 Ha ..... H01L 23/49638
9,081,457 B2 * 7/2015 Solven ..... G06F 3/044
2007/0126721 A1 * 6/2007 Kurokawa ..... G06F 3/1431 345/204
2009/0244035 A1 * 10/2009 Cho ..... G02F 1/13452 345/204
2010/0214519 A1 * 8/2010 Hwang ..... G02F 1/13452 349/150
2011/0248972 A1 * 10/2011 Ahn ..... G09G 3/3648 345/206
2013/0335123 A1 * 12/2013 Choi ..... H03K 17/165 327/109
2014/0239317 A1 * 8/2014 Bang ..... H05K 1/145 257/88
2015/0022989 A1 * 1/2015 Dunphy ..... H05K 3/222 361/783
2015/0230337 A1 * 8/2015 Kim ..... H05K 1/118 361/751

FOREIGN PATENT DOCUMENTS

JP 07-325316 12/1995
JP 2006-032056 2/2006

* cited by examiner

DISPLAY MODULE WITH DUAL POWER LINES

CROSS-REFERENCE TO RELATED APPLICATIONS

This application claims priority under 35 USC §119 to Korean Patent Application No. 10-2012-141982, filed on Dec. 7, 2012 in the Korean Intellectual Property Office (KIPO), the disclosure of which is incorporated by reference herein in its entirety.

TECHNICAL FIELD

Exemplary embodiments of the present inventive concept relate to a display module. More particularly, exemplary embodiments of the present inventive concept relate to a display module with dual power lines.

DISCUSSION OF THE RELATED ART

Generally, a display module may include a display panel, a printed circuit board (PCB), a driver integrated circuit and a flexible printed circuit (FPC). The A PCB may generate drive signals for driving the display panel. The driver integrated circuit may be mounted to the display panel, and the driver integrated circuit may transmit the drive signal and a power to the display panel. The FPC may be electrically connected between the driver integrated circuit and the PCB.

The FPC may include the power wiring for transmitting the power, and the drive signal wirings for transmitting the drive signal. The power wirings may be arranged on a lower plane of the FPC. The drive signal wirings may be arranged on an upper plane of the FPC. The power wirings and the drive signal wirings may intersect each other.

A ground slit may cause a discontinuity of the drive signal wirings. A discontinuity may be generated due to the intersection between the drive signal wirings and the power wirings. The ground slit may change an impedance of the drive signal wirings. The drive signal transmitted through the drive signal wirings may be distorted by the change in impedance. For example, the power wiring intersecting the drive signal wiring may cause an electromagnetic interference (EMI).

SUMMARY

Exemplary embodiments of the present inventive concept may provide a display module capable of preventing the generation of ground slits.

According to some exemplary embodiments of the present inventive concept, a display module may be provided. The display module may include a display panel, a driver integrated circuit, a flexible printed circuit (FPC), a drive signal wiring and a power wiring. The driver integrated circuit may apply a power and a drive signal to the display panel. The FPC may be electrically connected between the driver integrated circuit and a printed circuit board (PCB). The drive signal wiring may be extended from the FPC to the display panel through the driver integrated circuit on a first plane. The drive signal wiring may be extended from a FPC to a display panel through a driver integrated circuit on the first plane to transmit the drive signal to the display panel. The power wiring may transmit the power to the display panel. The power wiring may include a first power line extended from the FPC to the driver integrated circuit, and a second power line extended from the first power line to the display panel on a second plane different from the first plane.

In exemplary embodiments of the present inventive concept, the first plane and the second plane may be parallel with each other.

In exemplary embodiments of the present inventive concept, the first plane may be an upper surface of the display panel. The second plane may be a lower surface of the display panel.

In exemplary embodiments of the present inventive concept, the second power line may include first sub-lines and second sub-lines. The first sub-lines may be arranged at both sides of the first power line. The first sub-lines may be extended in parallel with the first power line. The second sub-lines may be connected to ends of the first sub-lines. The second sub-lines may be configured to surround the ends of the first sub-lines.

In exemplary embodiments of the present inventive concept, the second sub-lines may be substantially perpendicular to the first sub-lines.

In exemplary embodiments of the present inventive concept, the first power line may be arranged on the first plane.

In exemplary embodiments of the present inventive concept, the power wiring may include a plug formed in the display module to electrically connect the first power line with the second power line.

In exemplary embodiments of the present inventive concept, the display module may further include a first conductive film interposed between the display panel and the drive integrated circuit, and a second conductive film interposed between the display panel and the FPC.

In exemplary embodiments of the present inventive concept, the second conductive film may have a plug portion inserted into the display panel to electrically connect the first power line with the second power line.

According to exemplary embodiments of the present inventive concept, a display module may be provided. The display module may include a display panel, a driver integrated circuit, a flexible printed circuit (FPC), a drive signal wiring and a power wiring. The display panel may include an upper panel and a lower panel. The drive signal wiring may be arranged on an upper surface of the lower panel. The power wiring may include a first power line arranged on the upper surface of the lower panel in a first direction, and a second power line arranged on a lower surface of the lower panel in a second direction. A second direction may be substantially perpendicular to the first direction. The driver integrated circuit may apply a power and a drive signal to the display panel through the drive signal wiring and the power wiring. The FPC may be electrically connected between the driver integrated circuit and a printed circuit board (PCB).

In exemplary embodiments of the present inventive concept, the second power line may include first sub-lines and second sub-lines. The first sub-lines may be arranged at both sides of the first power line. The first sub-lines may be extended in parallel to the first power line. The second sub-lines may be connected to ends of the first sub-lines. The second sub-lines may be configured to surround the ends of the first sub-lines.

In exemplary embodiments of the present inventive concept, the display module may further include a first conductive film interposed between the display panel and the drive integrated circuit, and a second conductive film interposed between the display panel and the FPC.

In exemplary embodiments of the present inventive concept, the second conductive film may have a plug portion inserted into the display panel electrically connecting the first power line with the second power line.

According to exemplary embodiments of the present inventive concept, the second power line of the power wiring may be arranged at the display panel, and the second power line need not intersect with the drive signal wiring. A ground slit need not be generated between the power wiring and the drive signal wiring. As a result, the drive signal transmitted through the drive signal wiring need not be distorted.

BRIEF DESCRIPTION OF THE DRAWINGS

A more complete appreciation of the present disclosure and many of the attendant aspects thereof will be readily obtained as the same becomes better understood by reference to the following detailed description when considered in connection with the accompanying drawings, wherein.

DETAILED DESCRIPTION OF THE EMBODIMENTS

Figure 1:
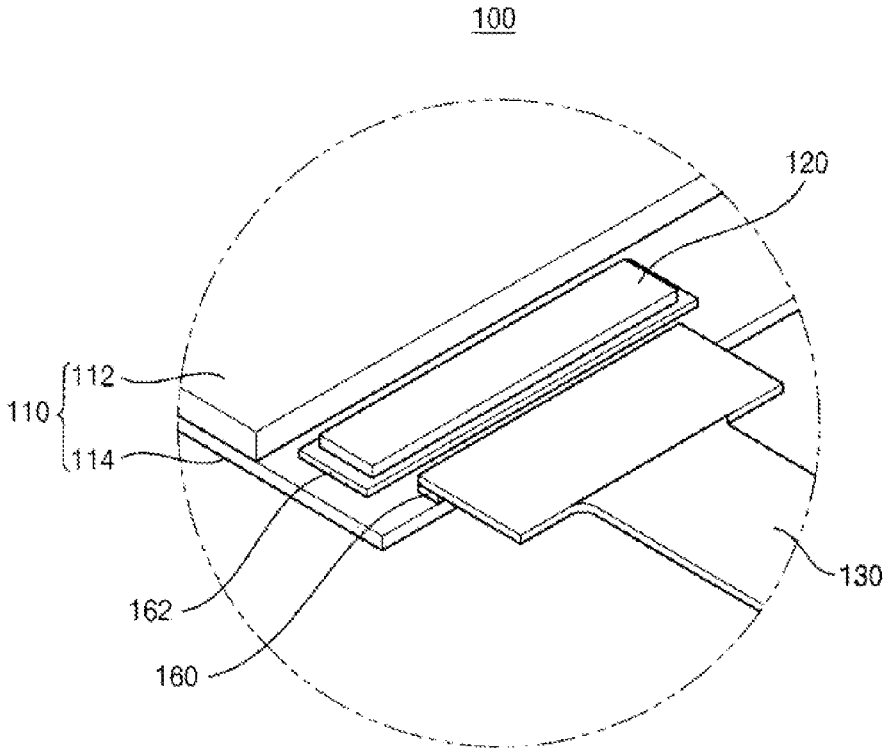
FIG. 1 is a perspective view illustrating a display module in accordance with exemplary embodiments of the present inventive concept.

Various exemplary embodiments of the present inventive concept will be described more fully hereinafter with reference to the accompanying drawings, in which some exemplary embodiments of the present inventive concept are shown. The present invention may, however, be embodied in many different forms and should not be construed as limited to the exemplary embodiments of the present inventive concept set forth herein. Rather, these exemplary embodiments of the present inventive concept are provided so that this disclosure will be thorough and complete, and will fully convey the scope of the present invention to those skilled in the art. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. Like numerals may refer to like elements throughout the disclosure.

Exemplary embodiments of the present inventive concept are described herein with reference to cross-sectional illustrations that may be schematic illustrations of idealized exemplary embodiments of the present inventive concept (and intermediate structures). As such, variations from the shapes of the illustrations, for example, of manufacturing techniques and/or tolerances, may be expected. Thus, exemplary embodiments of the present inventive concept should not be construed as limited to the particular shapes of regions illustrated herein but are to include deviations in shapes that result, for example, from manufacturing.

Hereinafter, exemplary embodiments of the present inventive concept will be explained in detail with reference to the accompanying drawings.

Figure 2:
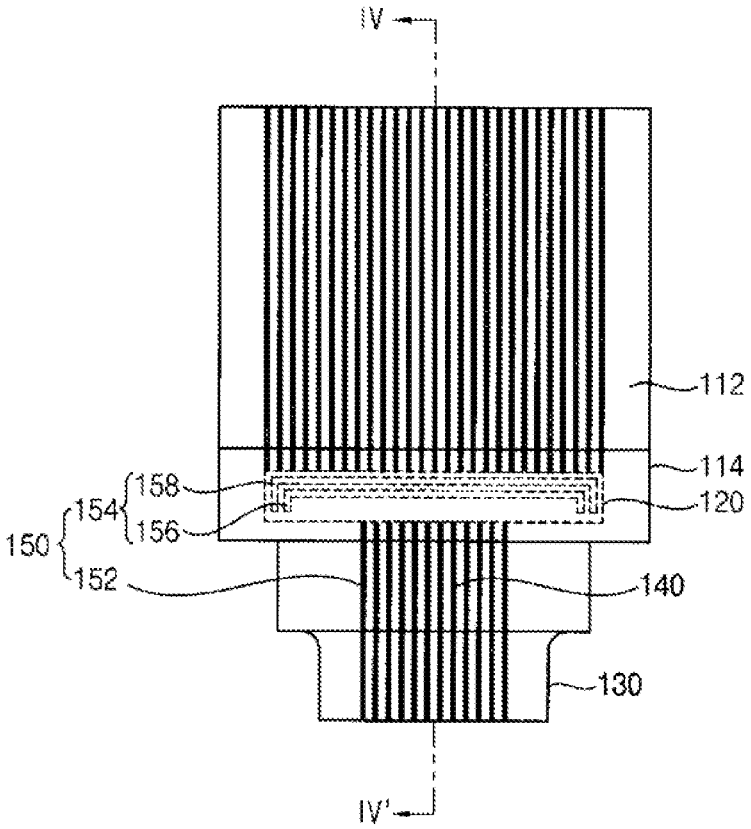
FIG. 2 is a plan view illustrating the display module in FIG. 1.
Figure 3:
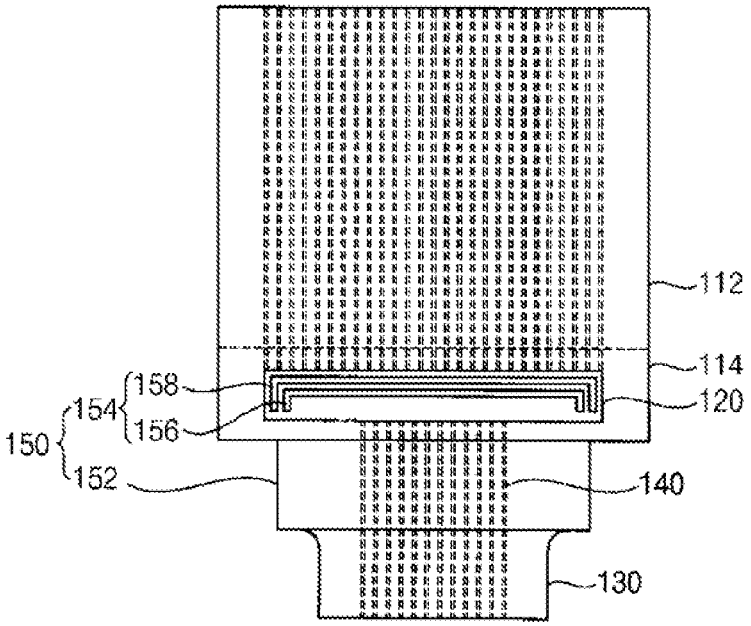
FIG. 3 is a bottom view illustrating the display module in FIG. 1.
Figure 4:
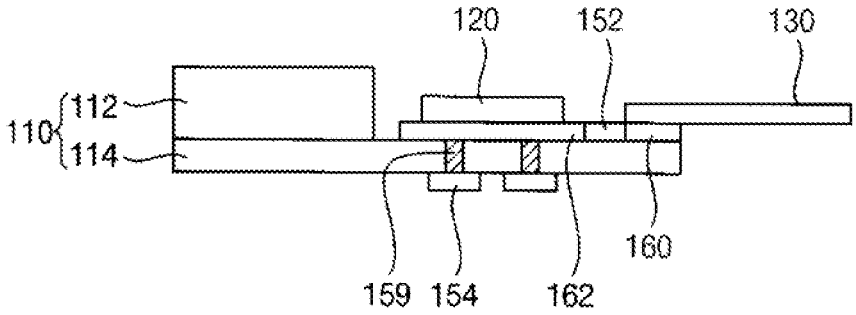
FIG. 4 is a cross-sectional view taken along a line IV-IV' in FIG. 2.

FIG. 1 is a perspective view illustrating a display module in accordance with exemplary embodiments of the present inventive concept. FIG. 2 is a plan view illustrating the display module in FIG. 1. FIG. 3 is a bottom view illustrating the display module in FIG. 1. FIG. 4 is a cross-sectional view taken along a line IV-IV' in FIG. 2.

Referring to FIGS. 1 to 4, a display module 100 of this example embodiment may include a display panel 110, a driver integrated circuit 120, a flexible printed circuit (FPC) 130, a drive signal wiring 140 and a power wiring 150.

The display panel 110 may display an image responsive to a drive signal. The drive signal may be transmitted from a printed circuit board (PCB) (not shown). A power may be supplied to the display panel 110. The drive signal and the power may be transmitted to the display panel 110 through the drive signal wiring 140 and the power wiring 150. The display panel 110 may include an upper panel 112 on which display elements may be arranged, and a lower panel 114 on which wirings may be arranged.

In exemplary embodiments of the present inventive concept, the display panel 110 may include an organic light emitting display (OLED) panel. The display panel 110 may include other display panels such as a liquid crystal display (LCD) panel, a plasma display panel, etc.

The driver integrated circuit 120 may be arranged on an edge portion of an upper surface of the lower panel 114 in the display panel 110. The driver integrated circuit 120 may apply the drive signal and the power to the display panel 110. In exemplary embodiments of the present inventive concept, the driver integrated circuit 120 may be attached to the edge portion of the upper surface of the lower panel 114 using a second conductive film 162. The second conductive film 162 may include an anisotropic conductive film (ACF).

The FPC 130 may be electrically connected between the driver integrated circuit 120 and the PCB. The FPC 130 may be arranged on the edge portion of the upper surface of the lower panel 114. The FPC 130 may be extended from the driver integrated circuit 120 toward the PCB. Thus, the FPC 130 may be positioned between the driver integrated circuit 120 and the PCB. In exemplary embodiments of the present inventive concept, the FPC 130 may be attached to the edge portion of the upper surface of the lower panel 114 using a first conductive film 160. The first conductive film 160 may include an ACF.

The drive signal wiring 140 may be extended from the FPC 130 to the driver integrated circuit 120 in a first direction. The drive signal wiring 140 may be electrically connected to the display panel 110. The driver signal wiring 140 may include one or more wirings arranged in the FPC 130, and one or more wirings arranged in the driver integrated circuit 120. In exemplary embodiments of the present inventive concept, the drive signal wiring 140 may be arranged on a first plane. The FPC 130 and the driver integrated circuit 120 may be positioned on the edge portion of the upper surface of the display panel 110. The first plane may correspond to the upper surface of the lower panel 114.

The power wiring 150 may be extended from the FPC 130 to the lower panel 114 of the display panel 110 through the driver integrated circuit 120. In exemplary embodiments of the present inventive concept, the power wiring 150 may include a first power line 152 and a second power line 154.

The first power line 152 may be arranged in the FPC 130 and the driver integrated circuit 120. The first power line 152 may be positioned at both sides of the drive signal wiring 140 in the first direction. The first power line 152 may be arranged on the first plane. The first power line 152 may be substantially parallel to the drive signal wiring 140. The first power line 152 and the drive signal wiring 140 may be substantially parallel with each other. The first power line 152 need not intersect the drive signal wiring 140.

The second power line 154 may extend from the first power line 152 to the lower panel 114 of the display panel 110. The second power line 154 may be positioned in the display panel 110. In exemplary embodiments of the present inventive concept, the second power line 154 may be positioned on a second plane different from the first plane. The second plane may correspond to a lower surface of the lower panel 114. Therefore, the first power line 152 may be arranged on the upper surface of the lower panel 114. The second power line 154 may be arranged on the lower surface of the lower panel 114.

The power wiring 150 may further include a plug 159. The plug 159 may be vertically formed in the edge portion of the lower panel 114. The plug 159 may be electrically connected between the first power line 152 and the second power line 154. In exemplary embodiments of the present inventive concept, the plug 159 may be formed by a process for forming a via hole through the lower panel 114, a process for forming a seed layer on an inner surface of the via hole, and/or a plating process on the seed layer.

In exemplary embodiments of the present inventive concept, the second power line 154 may include one or more first sub-lines 156 and one or more second sub-lines 158. The one or more first sub-lines 156 may be extended from the first power line 152 in the first direction. The first power line 152 may be located at two opposite sides of the drive signal wiring 140. One or more first sub-lines 156 substantially parallel to the first power line 152 may also be positioned at the opposing sides of the drive signal wiring 140.

The one or more second sub-lines 158 may be connected between ends of the first sub-lines 156, the on or more second sub-lines 158 being oriented toward the upper panel 112. The one or more second sub-lines 158 may be extended in a second direction substantially perpendicular to the first direction. In exemplary embodiments of the present inventive concept, ends of the one or more first sub-lines 156 oriented toward the upper panel 112 may be positioned closer to the upper panel 112 than an end of the drive signal wiring 140. The one or more second sub-lines 158 may surround the end of the drive signal wiring 140. The one or more second sub-lines 158 need not intersect a drive signal wiring 140.

According to exemplary embodiments of the present inventive concept, the one or more first sub-lines 158 substantially parallel to the drive signal wiring 140 may be positioned at the opposing sides of the drive signal wiring 140. The one or more second sub-lines 158 may surround the end of the drive signal wiring 140. The second power line 154 on the lower surface of the lower panel 114 need not intersect a drive signal wiring 140. The ground slit, which may be caused by an intersection between the power wiring 150 and the drive signal wiring 140, need not be generated. As a result, the drive signal transmitted through the drive signal wiring 140 need not be distorted.

Figure 5:
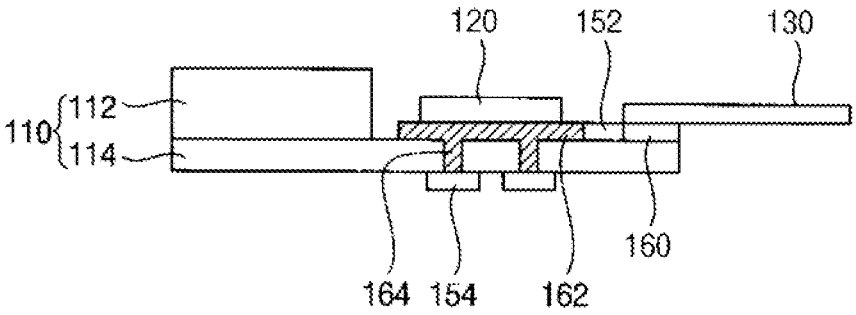
FIG. 5 is a cross-sectional view illustrating a display module in accordance with exemplary embodiments of the present inventive concept.

FIG. 5 is a cross-sectional view illustrating a display module in accordance with exemplary embodiments of the present inventive concept.

A display module 100*a* of an exemplary embodiment of the present inventive concept may include elements substantially the same as those of the display module 100 in FIG. 1 except for a plug. The same reference numerals may refer to the same elements and any further illustrations with respect to the same elements may be omitted herein for brevity.

Referring to FIG. 5, the second conductive film 162 may have a plug portion 164. For example, the plug portion 164 may be integrally formed with the second conductive film 162. The plug portion 164 may be inserted into the via hole in the lower panel 114. The first power line 152 and the second power line 154 may be electrically connected with each other via the plug portion 164.

According to exemplary embodiments of the present inventive concept, the second power line of the power wiring may be arranged at the display panel, so that the second power line need not intersect a drive signal wiring. Thus, a ground slit need not be generated between the power wiring and the drive signal wiring. As a result, the drive signal transmitted through the drive signal wiring need not be distorted.

The foregoing is illustrative of exemplary embodiments of the present inventive concept and is not to be construed as limiting thereof. Although a few exemplary embodiments of the present inventive concept have been described, those skilled in the art will readily appreciate that many modifications are possible in the exemplary embodiments of the present inventive concept without materially departing from the novel teachings of the present inventive concept. Accordingly, all such modifications are intended to be included within the scope of the present inventive concept.

What is claimed is:

1. A display module comprising:

a display panel;

a driver integrated circuit configured to apply a power and a drive signal to the display panel;

a flexible printed circuit (FPC) electrically connected between the driver integrated circuit and a printed circuit board (PCB);

a drive signal wiring extended from the FPC to the display panel through the driver integrated circuit on a first plane, the drive signal wiring configured to transmit the drive signal to the display panel; and a power wiring configured to transmit the power to the display panel, the power wiring comprising a first power line extended from the FPC to the driver integrated circuit, and including a second power line extended from the first power line to the display panel on a second plane, the second plane being different from the first plane, wherein the first power line is disposed at opposite sides of the drive signal wiring on the FPC without overlapping the drive signal wiring.

2. The display module of claim 1, wherein the first plane and the second plane are substantially parallel to each other.

3. The display module of claim 2, wherein the first plane corresponds to an upper surface of the display panel, and the second plane correspond to a lower surface of the display panel.

4. The display module of claim 1, wherein the second power line comprises:

first sub-lines arranged at two opposite sides of the first power line, the first sub-line being parallel to the first power line; and second sub-lines connected between ends of the first sub-lines, the second sub-lines configured to surround an end of the first power line.

5. The display module of claim 4, wherein the second sub-lines are substantially perpendicular to the first sub-lines.

6. The display module of claim 1, wherein the first power line is arranged on the first plane.

7. The display module of claim 1, wherein the power wiring further comprises a plug disposed in the display panel, wherein the plug electrically connects the first power line to the second power line.

8. The display module of claim 1, further comprising:

a first conductive film interposed between the display panel and the driver integrated circuit; and a second conductive film interposed between the display panel and the FPC.

9. The display module of claim 8, wherein the second conductive film has a plug portion positioned in the display panel, wherein the plug is configured to electrically connect the first power line with the second power line.

* * * * *